US005905804A

United States Patent [19]

Lee

[11] Patent Number: 5,905,804

[45] Date of Patent: May 18, 1999

[54] PAD STRUCTURE FOR A SPEAKER CABINET

[76] Inventor: Tzu-min Lee, 4th Fl., No. 4, Lane 94, Chiu Kang St., Taipei, Taiwan

[21] Appl. No.: 08/816,803

[22] Filed: Mar. 19, 1997

[51] Int. Cl.[6] ..... H04R 25/00

[52] U.S. Cl. ..... 381/386; 381/354; 381/87; 248/638

[58] Field of Search ..... 381/158, 159, 381/188, 205, 353, 354, 386, 388, 87, 332, 333; 248/638, 603; 181/199, 151, 198

[56] References Cited

U.S. PATENT DOCUMENTS 5,169,104 12/1992 Kwoh ..... 248/638
5,261,200 11/1993 Sasaki et al. ..... 248/638

*Primary Examiner*—Huyen Le
*Attorney, Agent, or Firm*—Foley & Lardner

[57] ABSTRACT

A pad structure for speaker cabinet includes a lower disk having a plurality of recesses defined in a top surface thereof, an upper disk having a corresponding number of recesses defined at positions on a bottom surface thereof facing to the recesses of the lower disk, respectively, and a corresponding number of balls. Each of the balls is sandwiched between one of the recesses of the lower disk and a corresponding one of the recesses of the upper disk. The pad structure is put under the speaker cabinet to reduce the vibration generated by the cabinet when the speaker produces sound, provide the reaction force necessary for the speaker when producing sound and effectively insulate the cabinet from the vibration due to the natural resonance of the place where the cabinet is positioned.

6 Claims, 3 Drawing Sheets

PAD STRUCTURE FOR A SPEAKER CABINET

BACKGROUND OF THE INVENTION

1. Field of the Invention

The present invention relates to a pad structure for a speaker cabinet, which can reduce the undesirable harmonics generated from the cabinet when the speaker is in use, provide the necessary reaction force, and insulate the cabinet from a coloration of sound due to the natural resonance of the material of the place where the cabinet is positioned.

2. Description of Related Art

For a user of phonographic equipment, avoiding undesirable vibrations of the speaker cabinet is very important since such vibrations may degrade the sound quality of the speaker.

In operation, electrical signals converted from music are transmitted to a coil of the speaker, causing a cone to vibrate air to produce sound. Based on the principle of action and reaction, it is necessary for the cone to be supported when producing sound, and the cabinet is typically used to carry and support the cone. The cabinet and a place where the cabinet positioned are receivers for the reaction when the cone vibrates to produce sound. However, the cabinet and the place may generate various degrees of resonances and harmonics due to various materials and configurations thereof when receiving the reaction. Vibrations such as those resonances and harmonics feed back to the cone, and therefore noises are generated, resulting in degradation of the quality of the sound produced by the speaker.

A conventional method for reducing the vibration of the speaker cabinet is to provided pads made of vibration-absorbing material such as rubber or rigid material such as marble or metal on the bottom of the cabinet. However, although the vibration-absorbing material can absorb the vibration generated from the cabinet, such material also has a negative influence on the reaction applied by the cabinet to the cone, and the reaction is necessary when the cone produces sound. On other hand, using rigid material to carry the speaker can reduce the vibration due to the natural resonance of the place where the cabinet is positioned, however, the vibration generated from the cabinet itself can not be avoided.

There has been a pad structure for speaker cabinet provided to solve the above problem. Referring to FIG. 4, the pad structure comprises a bottom disk 50 having a conical hole 51 defined in the center, and a conical piece 60, the conical piece 60 supports the speaker cabinet with a top surface thereof, and the tip of the conical piece 60 can be received in the conical hole 51. By such arrangement, the vibration due to the natural resonance of the place where the cabinet is positioned can be insulated. However, the problem with respect to the vibration generated by the cabinet itself can not be solved effectively.

SUMMARY OF THE INVENTION

One object of the present invention is to provide an improved pad structure for a speaker cabinet, which can reduce the vibration generated by the cabinet when the speaker produces sound, provide the reaction force necessary for the speaker when producing sound and effectively insulate the cabinet from the vibration due to the natural resonance of the place where the cabinet is positioned.

In accordance with one aspect of the present invention, the pad structure for speaker cabinet comprises a lower disk having a plurality of recesses defined in a top surface thereof, an upper disk having a corresponding number of recesses defined at positions on a bottom surface thereof facing to the recesses of the lower disk, respectively, and a corresponding number of balls, each of the balls being sandwiched between one of the recesses of the lower disk and a corresponding one of the recesses of the upper disk. Each of the balls makes two-point contact with each of the lower disk and the upper disk, respectively.

Other objects, advantages and novel features of the invention will become more apparent from the following detailed description when taken in conjunction with the accompanying drawings.

DETAILED DESCRIPTION OF PREFERRED EMBODIMENT

Figure 1:
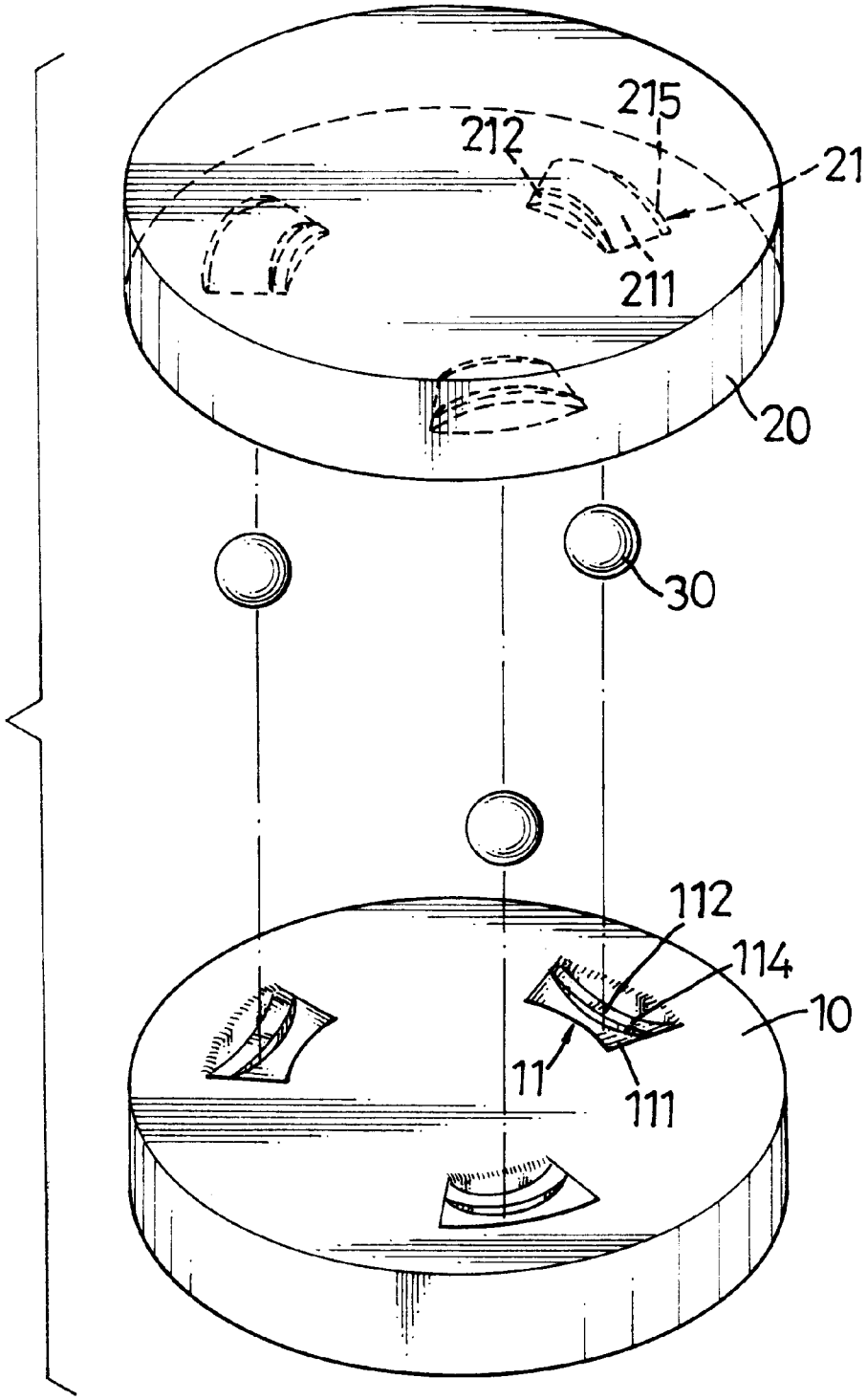
FIG. 1 is an exploded perspective view of the pad structure in accordance with the present invention.
Figure 3:
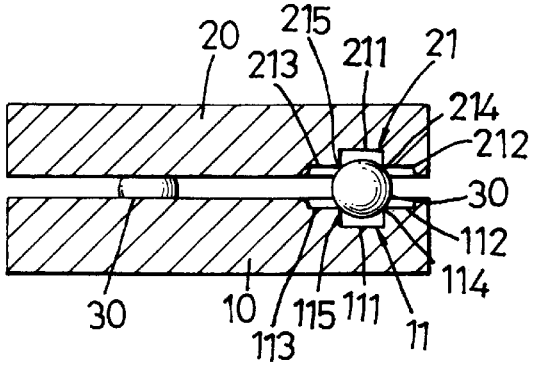
FIG. 3 is a cross-sectional view of the pad structure in accordance with the present invention.
Figure 4:
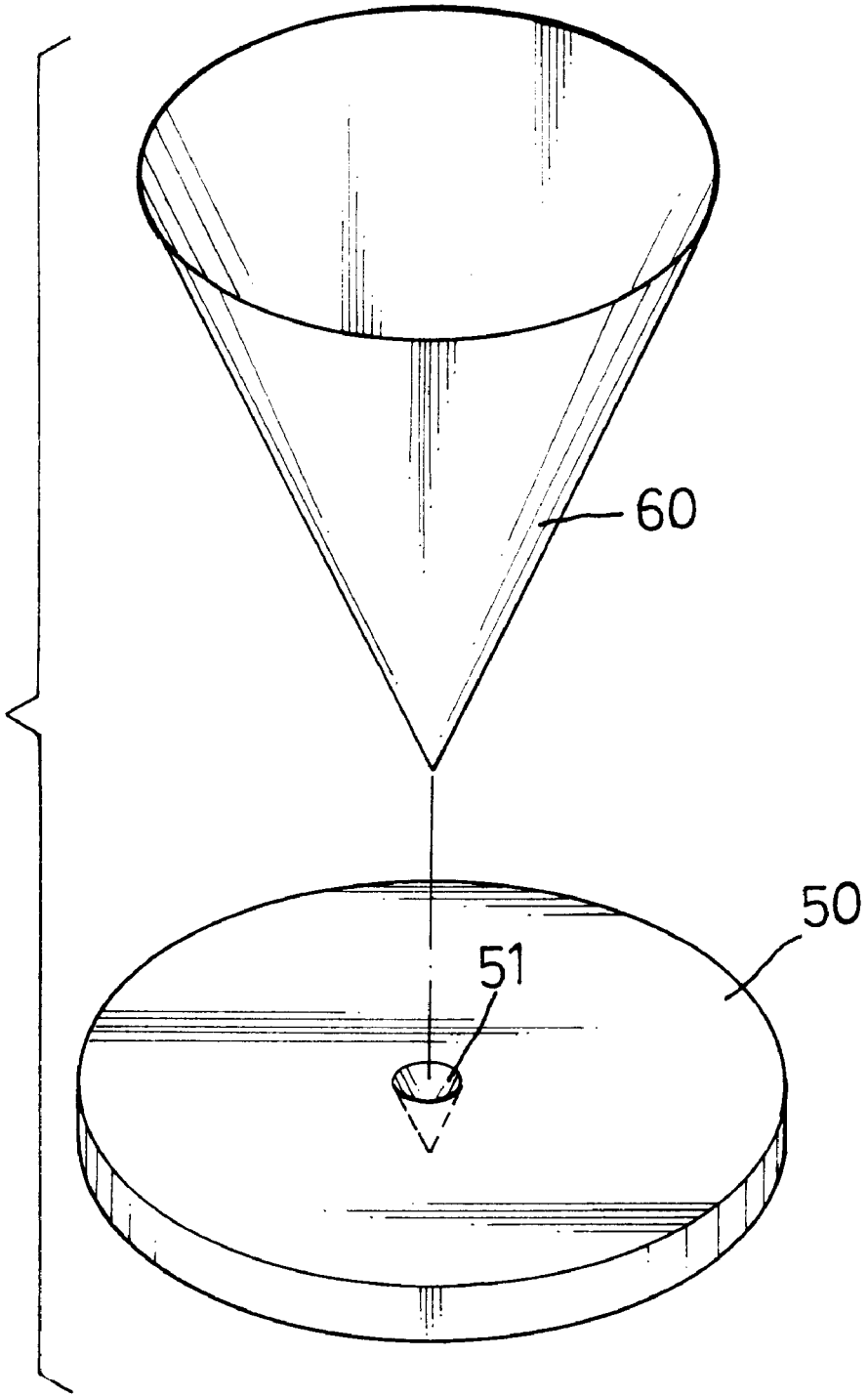
FIG. 4 PRIOR ART
FIG. 4 in an exploded perspective view of a conventional pad structure.

Referring to Fig.1 and FIG. 3, the pad structure for speaker cabinet of an embodiment in accordance with the present invention comprises a lower disk 10 having three recesses 11 defined in a top surface thereof, an upper disk 20 also having three recesses 21 being defined in a bottom surface thereof and facing to the recesses 11 respectively, and three balls 30, each of which is sandwiched between one of the recesses 11 of the lower disk 10 and the corresponding recesses 21 of the upper disk 20. The lower disk 10 and the upper disk 20 are made of rigid material.

As shown in the drawings, a respective bottom defining a bottom of each of the recesses 11, 21 has a groove (111, 211) defined therein, and accordingly two steps (112, 113 or 212, 213) are formed at the two sides of the groove (111, 211), whereby defining an edge (114, 115 or 214, 215) between the groove (111 or 211) and either of the steps (112, 113 or 212, 213), respectively. In the present embodiment, a bottom of the groove (111 or 211), the steps (112, 113 or 212, 213) and the edges (114, 115 or 214, 215) are formed to be curved.

Each of the balls 30 has a diameter larger than a width of each of the groove (111, 211), so that the ball 30 contacts the lower disk 10 and upper disk 20 only at four respective points on the edges 114, 115 and 214, 215 when the ball 30 is sandwiched between the recess 11 and recess 21. The balls 30 are made of rigid material such as glass or ceramic.

In the present embodiment, the three recesses 11 (or 21) are formed concentrically.

Figure 2:
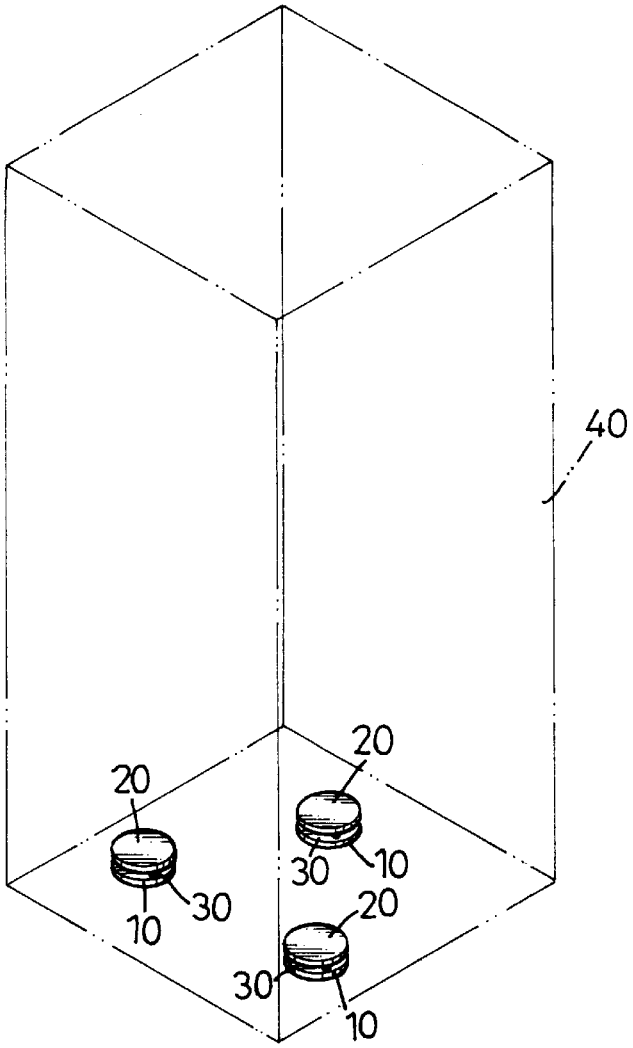
FIG. 2 shows the pads in accordance with the present invention supporting a speaker cabinet.

For utilization, see FIG. 2, wherein three or more pads are shown under a speaker cabinet 40 to support the speaker. Each of the ball 30 of the pad can always be located at the lowest position since it can roll along the edges 114, 115 (214, 215). Accordingly, the vibrations generated by the cabinet 40 when the speaker produces sound or due to arbitrary undesirable action force can be reduced. In addition, since each of the balls 30 is made of material with high hardness such as steel, glass or ceramic, transfiguration will not occur to the balls 30 even if they are pressed by a heavy weight, whereby the pad can provide sufficient reaction force when the speaker disposed thereon produces sound. Furthermore, as described above, each of the balls 30 contact the lower disk 10 and upper disk 20 by only four points at the edges 114, 115, 214, 215 respectively when the ball 30 is sandwiched between the recess 11 of the lower disk 10 and the corresponding recess 21 of the upper disk 20. The ball 30 can always be located at a balanced and stable position since it can roll along the edges (114, 115 or 214, 215) as the cabinet disposed upon the pads vibrates. By such arrangement, the coloration of sound due to the natural resonance of the material of the place where the cabinet 40 is positioned can be insulated effectively.

Although the pads in accordance with the present invention is used for the speaker as above, however, the pads can also be used to disposed under a CD player or a turntable for reducing the undesirable vibrations to avoid the degradation of the sound.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pad structure for a speaker cabinet, which is used to support the speaker cabinet for reducing undesirable vibrations, comprising:

a lower disk having a plurality of first recesses defined in a top surface;

an upper disk having a plurality of second recesses defined in a bottom surface, each of said second recesses facing a corresponding one of said first recesses; and a plurality of balls each being rollably sandwiched between one of said first recesses and a corresponding one of said second recesses, each of said balls being capable of rolling to a balanced and stable position between said recesses to reduce the undesirable vibration when the speaker cabinet vibrates;

wherein a respective bottom portion defining each of said first and second recesses further defined a groove, and two steps being formed at two sides of said groove respectively, wherein a respective edge is defined between each of said steps and said groove.

2. The pad structure according to claim 1, wherein a diameter of each of said balls is larger than a width of said groove.

3. The pad structure according to claim 2, wherein each of said balls is made of rigid material.

4. The pad structure according to claim 3, wherein each of said balls is made of glass.

5. The pad structure according to claim 3, wherein each of said balls is made of ceramics.

6. The pad structure according to claim 3, wherein each of said balls is made of steel.

* * * * *